United States Patent [19]

Morrison et al.

[11] Patent Number: 4,979,270

[45] Date of Patent: Dec. 25, 1990

[54] APPARATUS AND METHODS FOR CONVERTING TOW INTO STAPLE

[75] Inventors: Elbert F. Morrison, Clarksburg, Va.; D. C. Reece, Oxford, N.C.

[73] Assignee: Burlington Industries, Inc., Greensboro, N.C.

[21] Appl. No.: 388,823

[22] Filed: Aug. 3, 1989

[51] Int. Cl.[5] ..... D01H 1/10

[52] U.S. Cl. ..... 19/0.6; 19/0.35

[58] Field of Search ..... 19/150, 0.37, 0.35, 19/0.56, 0.60, 243, 236, 244, 258

[56] References Cited

U.S. PATENT DOCUMENTS

| | | | |
|---|---|---|---|
| 19,011 | 1/1858 | Baldwin | 19/150 |
| 110,021 | 12/1870 | Draper | 19/150 |
| 143,508 | 10/1873 | Good | 19/150 |
| 217,170 | 7/1879 | Tibbetts | 19/150 |
| 2,003,400 | 6/1935 | Taylor et al. | 19/0.37 |
| 2,230,399 | 2/1941 | Brandt et al. | 19/244 |
| 2,438,469 | 3/1948 | Wilkie . | |
| 2,706,834 | 4/1955 | Wilkie . | |
| 2,761,179 | 9/1956 | Lepoutre . | |
| 3,500,504 | 3/1970 | Oguchi et al. . | |
| 3,522,634 | 8/1970 | Morrison et al. . | |
| 3,715,780 | 2/1973 | Chaikin et al. | 19/236 |
| 3,748,695 | 7/1973 | Shino et al. . | |
| 3,751,768 | 8/1973 | Morrison et al. . | |
| 3,881,230 | 5/1975 | Arnold et al. . | |
| 3,908,232 | 9/1975 | Okayama et al. . | |
| 3,913,176 | 10/1975 | Grossi . | |
| 3,942,223 | 3/1976 | Roger | 19/258 |
| 3,952,372 | 4/1976 | Howell, Jr. . | |
| 3,955,255 | 5/1976 | Shields, Jr. . | |
| 3,968,543 | 7/1976 | Shino et al. . | |
| 3,988,807 | 11/1976 | Ueda et al. . | |
| 4,030,165 | 6/1977 | Schmitt et al. . | |
| 4,389,752 | 6/1983 | Briner et al. | 19/0.6 |
| 4,399,589 | 8/1983 | Hefti | 19/0.6 |
| 4,727,626 | 3/1988 | Vinas . | |

FOREIGN PATENT DOCUMENTS

| | | | |
|---|---|---|---|
| 695813 | 9/1940 | Fed. Rep. of Germany | 19/0.6 |
| 740331 | 10/1943 | Fed. Rep. of Germany | 19/0.56 |
| 741300 | 11/1943 | Fed. Rep. of Germany | 19/0.6 |

OTHER PUBLICATIONS

"Rotodisc Drafter ZS19, Rotodisc Drafter with Autoleveller ZSR20" Brochure, Schubert & Salzer Maschinenfabrik Aktiengesellschaft.

*Primary Examiner*—Werner H. Schroeder
*Assistant Examiner*—John J. Calvert
*Attorney, Agent, or Firm*—Nixon & Vanderhye

[57] ABSTRACT

Disclosed are apparatus and methods for converting tow into sliver including cutter rolls for cutting fiber to length, a collector pan for passing the cut fiber from the cutting rolls to a drafting section and a pin roll in the drafting section for combing and debonding the fiber. The collector pan is shaped to dispose the opposite marginal edges of the cut fiber web in registration with the main body of the web to ensure proper presentation of the cut tow fibers to the drafting section. The pin roll in the drafting section includes a plurality of projections having leading and trailing edges terminating in a tip. Each leading edge is angled to enter the tow web prior to entry of the associated tip. The arrangement of the converter affords high weight delivery of combed and debonded fiber with minimal defects.

17 Claims, 9 Drawing Sheets

APPARATUS AND METHODS FOR CONVERTING TOW INTO STAPLE

BACKGROUND AND SUMMARY OF THE INVENTION

The present invention relates to apparatus and methods for converting tow into sliver and particularly relates to apparatus and methods for converting continuous filament tow into staple fibers having substantially uniform orientation relative to one another and drafted to form a substantially homogeneous sliver.

Continuous filament tow has been converted previously into staple sliver by an apparatus known in the textile trade as the Pacific Converter. Such process is described and illustrated in U.S. Pat. No. 2,438,469, granted Mar. 23, 1948. However, stock processed through that machine was of poor quality and required multiple process steps to render it suitable for use in apparel fabrics, e.g., worsted fabrics.

Subsequently, another converter was developed and placed into use on a production basis and which converter constituted a substantial improvement over the Pacific Converter. This improved apparatus is described and illustrated in U.S. Pat. No. 3,522,634, granted Aug. 4, 1970, of common assignee herewith. While the production speed of that improved apparatus is substantial, it too has certain drawbacks. For example, for apparel fabrications, a substantial majority of the tows processed by the apparatus according to that patent still require recombing after blending with other fiber types. Additionally, while the machine operates at substantial speed, the productivity of the machine is not great. That is, the machine delivers lightweight sliver, on the order of 200 grains per yard. The speed of the apparatus cannot be increased because it employs a gill head having faller bars which constitute a limitation on the maximum speed attainable during the combing operation. Another principal drawback of that apparatus, which has been recognized for years, is that the mechanical gill heads and apron drafting used in that machine are very expensive and are very high-maintenance items. The high frequency of the required maintenance substantially increases the downtime of the machine, and, when coupled with the actual cost of repairs, provides for avery expensive machine operation. Also, these prior machines are undesirably sensitive to tow finish, denier, temperature and humidity.

It will also be appreciated that in any tow to staple converter, it is important to maintain the fibers parallel to one another in the drafting zone. It will also be appreciated that the cutter and anvil of these prior converters essentially apply great pressure to the tows passing through the nip to weaken the individual fibers. In such prior machines discussed above!where two or more tows are passed through the cutters, control of the tow stock through the cutter and anvil is to a large extent lost. That is, because of the combined thickness of the tows, the individual fibers are cut to a greater or lesser extent depending upon their position in the tow relative to the cutter and anvil. The uniformity of these points of weakness thus varied across the tow. Also, certain of the tow fibers would be cut entirely through, whereas others would be cut partially through and then to a greater or lesser extent according to their location in the combined tows. No uniformity of cutting action exists across the tows. As a result, certain of the fibers which were through-cut by the cutters would turn or curl sideways as they left the cutter and upon entry into the drafting zone, resulting in a high probability of defects in the sliver. That is, portions of the stock would separate between the cutter and faller bars and the pull of the input rolls to the faller bar head would separate the fibers prematurely, causing them to enter the faller bars sideways. All of this was caused by the non-uniform cutting action between the cutter and anvil.

The present invention constitutes an improvement in both apparatus and methods for converting tow to sliver, and affords substantial advantages in higher production capability, a higher quality product than capable with the prior apparatus and methods, and an apparatus which is mechanically simple, efficient, easier to repair at less cost, and which requires only minimum downtime for repairs. Particularly, in the apparatus and process of the present invention, one or more tows are provided for passage through individual cutters. Each cutter includes an anvil roll and a cutter roll provided with one or more helical lands such that, when the tow web passes between the rolls, diagonally parallel cuts substantially through the continuous filament are provided. The cut tow webs from the cutters are then superposed over one another. The diagonal cuts preferably lie in opposite directions such that, upon superposition of the webs, the diagonal cuts, in plan, extend in opposite diagonal directions. The unique cutter system fractures the tow into cut lengths but does' not completely sever the low fibers. This enables the cut tow fibers to be pulled forward across the collector pan into the drafting zone without separating.

The superposed tow webs then pass over a collector pan having a convex upper surface and lateral margins which extend inwardly toward one another below the upper surface. When the tow passes over the collector pan, its lateral margins or selvages turn or fold under to follow the contour of the collector pan. This locates such tow margins in registration with and below the main body of the tow upon exiting the collector pan.

The cut tow then passes through a first pair of draft rolls flanked on upstream and downstream sides by a pair of smooth, vertically extending, rolls which decrease the lateral extent of the tow. The tow then passes through a pair of pin rolls where the staple fiber is debonded and combed. The tow then passes through sets of drafting rolls and through a condensor to gather and reduce the sliver cross-section for exit through the final drafting rolls. The sliver, which is now made up of staple lengths oriented due to the various drafting stages, is fed into a crimper for compacting so that it may be run at high speeds and is then disposed in coiled form in a sliver can by a coiler.

It will be appreciated that, in the overall general arrangement of the present invention as previously described, there are various features and advantages of the present invention in comparison with the converter system, as set forth in U.S. Pat. No. 3,522,634 including higher productivity. For example, while the prior production version of the converter disclosed in U.S. Pat. No. 3,522,634 delivered four tow webs simultaneously at about 14.5 feet per minute, for a total of 5,608 grains per yard, it delivered only 200 grains per yard of sliver at 175 yards per minute, providing a draft of 22. The present invention, however, may provide tow at 102 feet per minute input from each of two tow cartons, with 2,804 grains per yard delivered, providing a 600 grain per yard sliver at 170 yards per minute, with a draft of 8.3. Thus, the total weight delivery of the sliver in accordance with the present invention is desirably much higher than previously obtained with the apparatus of U.S. Pat. No. 3,522,634. That higher output delivery is also obtained with relative mechanical simplicity and ease of repair. It also provides a better quality product. For example, each tow is cut at a single cutter in the present invention (in contrast to providing two or more tows through a single cutter). This improves productivity by reducing the required cutter pressure and hence increases the life of the cutter, as well as reduces the number of undesirable neps, pinpoints and short and long fibers.

Additionally, the construction of the present apparatus enables attachment of a blending device, for example, to blend wool with the polyester tow being cut and processed as described above. Such device may be located, for example, just beyond the pin rolls and before the following draft rolls. Thus, wool can be fed behind and into the draft rolls following the pin rolls on top of the cut staple fibers, making a sandwich of polyester and wool. As the combined wool and polyester sheets are drafted, they become a semi-intimate blend passing through the various draft rolls into a coiler at the desired delivery weight.

Apart from an overall improved apparatus, several individual features of the apparatus afford various advantages in construction, operation and result. For example, when tow is cut by cutter rolls, the leading edge of the cut tow tends to separate and fold backwards. This is a particular problem along the outer lateral margins or selvages of the cut tow, where the fiber ends may extend sideways or curl such that, when the fibers are presented for drafting, defects, e.g., fiber clusters, neps and pinpoints, readily occur. That is, the defects are usually due to the tow pulling apart prematurely before drafting such that the fibers are not straight for drafting. Rather, the fiber ends may be turned sideways.

The unique construction of the collector pan tends to minimize or eliminate the tendency of the leading edge and lateral margins of the cut tow to curl or lay back sideways. More particularly, the collector pan is in the form of an upwardly curved convex surface having lateral margins which are folded or turned inwardly below the convex curved surface. As the superposed cut tow ends emerge from the cutters for presentation to the drafting section, the tow slides across the top convex surface of the collector pan. Due to the shape of the pan, the margins of the sheet of cut fibers roll around the sides of the collector pan. Thus, the leading edges of the cut tow and the marginal portions of the web turn or fold about the lateral margins of the pan to a location below the main portion of the pan. The margins or selvage portions of the superposed tow ends thus lie in registration with the main body of the tow as the tow exits the collector pan.

It will also be appreciated, upon comparing the present invention with the converter illustrated in prior U.S. Pat. No. 3,522,634, that the present invention eliminates the previously utilized gill head in its entirety. Consequently, the mechanical problems associated with the use of a gill head, such as high repair costs and high maintenance components are eliminated. Importantly, the limitation on gill head speed is similarly eliminated in favor of the pin rolls of the present invention which are capable of higher operational speeds. The pin rollers, of course, comb and debond the cut fibers. In accordance with the present invention each pin roller comprises a plurality of discs mounted on a shaft and spaced one from the other in an axial direction. The pins of the opposed rolls lie in meshing engagement with one another while the axial spacing of the pins permits ample space between the pins to receive and comb the cut fibers. It is important in the present invention that the pins have a leading edge which is inclined back from the direction of rotation of the rollers such that the pins pass into the stock on the front side of the point of the pin. That is, the leading edge of each pin first engages the stock, followed by the tip of the pin. Otherwise, entry of the pin tip into the stock before the body of the pin would cause defects such as neps and pinpoints in the sliver.

Another important advantage of the present invention, apart from high production and improved quality, is that little or no crimp is lost from the fiber during processing. This is believed to be a result of the low fiber stretch on the apparatus. Crimp retention during processing is particularly important in subsequent processing of fine deniers. Consequently, this crimp retention capacity improves the processability of the sliver as well as its processability through roving and spinning operations.

Another important advantage of the present invention resides in the employment of a single tow being presented to the cutter. This results in a uniform cutting action across the tow as the tow emerges from the cutter substantially maintaining the tow stock parallel as it enters the drafting zone. More particularly, the tow is pressed between the cutter and anvil and a substantially uniform cut is provided the fibers across the tow as it passes through the cutter. The fibers are not cut entirely through but form weakened zones by the action of the cutter and anvil which enable the fibers to be severed by the pulling action in the drafting zone rather than prematurely before the drafting zone. Consequently, the fibers are maintained parallel one to the other upon exiting the cutter and entering the drafting zone, i.e., the pin roller arrangement. Thus, the fibers are controlled effectively as they pass through the cutter such that the cutter effects a substantially uniform cut in all of the fibers. Relatively few of the fibers are cut thus through by the cutter, thereby substantially minimizing or eliminating a sideways orientation of the fibers or a curl which might cause defects in the sliver when such improperly oriented fibers pass through the drafting zone. In short, the present invention provides uniform cuts at longitudinally and transversely spaced positions along the tow, which cuts are characterized by an essentially weakened fiber portion, enabling separation of the fibers in the drafting zone, i.e., by the pin roller arrangement hereof, minimal or no separation of the fibers prior to entry into the drafting zone.

Therefore, in accordance with a preferred embodiment of the present invention, there is provided apparatus for converting tow to sliver, comprising means for feeding a web of tow from a supply through the converting apparatus, means for cutting the web into staple fibers of substantially uniform length, means for turning the cut staple fibers along at least one marginal portion of the cut tow web into registration with a main portion of the tow web inwardly of the marginal portion, and a drafting section for receiving the turned tow web for forming the sliver.

In a further preferred embodiment of the present invention, there is provided apparatus for converting tow to sliver, comprising means for feeding a web of tow from a supply through the converting apparatus, and means for cutting the web into staple fibers of substantially uniform length, together with a drafting section for drafting the cut staple fibers to form a sliver. The drafting section includes a pin roll and a pair of drafting rolls immediately following the pin roll in the downstream direction of movement of the tow web, together with means for rotating the pin roll and the draft rolls. The pin roll has a plurality of projections extending therefrom, the projections being spaced circumferentially one from the other about the pin roll and spaced axially one from the other therealong. Each projection has a tip and leading and trailing edges extending therealong toward the tip, and each leading edge extends in a direction to engage the tow web first along the leading edge followed by engagement of the tip with the tow web as the pin roll is rotated and the projections engage the web.

In a still further preferred embodiment of the present invention, there is provided a method of processing tow to sliver in a converter, comprising feeding a web of tow from a supply through the converter, cutting the web into staple fibers of substantially uniform length, turning the cut staple fibers along at least one marginal portion of the cut tow web into registration with a main portion of the tow web inwardly of said marginal portion and passing the turned tow web through a drafting section to form the sliver.

In a still further preferred embodiment of the present invention, there is provided a method for processing tow to sliver in a converter, comprising feeding a web of tow from a supply through the converter, cutting the web into staple fibers of substantially uniform length and drafting the cut staple fibers to form a sliver including, in the drafting section, providing a pin roll and a pair of drafting rolls following the pin roll in the downstream direction of movement of the tow web, rotating the pin roll and the draft rolls at a peripheral speed greater than the linear speed of the cut tow web passing through the drafting section, forming a plurality of projections on the pin roll spaced circumferentially one from the other thereabout and extending axially therealong including forming on each projection a tip and leading and trailing edges extending therealong toward the tip, and engaging the web first along the leading edge followed by the tip as the pin roll is rotated and the projections engage the web.

In a still further preferred embodiment of the present invention, there is provided a method of cutting tow and presenting the cut tow to a drafting zone comprising the steps of passing tow having substantially parallel oriented tow fibers through the nip of a cutter and anvil and applying a substantially uniform pressure to the tow fibers as they pass through the nip to provide substantially uniform weakened zones in substantially each tow fiber at longitudinally spaced positions therealong and substantially without complete severing thereof whereby the cut, unsevered tow fibers are maintained connected and in parallel relation one to the other upon presentation to the drafting zone.

Accordingly, it is a primary object of the present invention to provide novel and improved apparatus and methods for converting continuous filament tow into staple fiber characterized by increased speed of operation, greater delivery weight of staple fiber, lower frequency of repair and maintenance, and a higher quality sliver with minimal defects in comparison with prior tow converters.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to the present preferred embodiment of the invention, an example of which is illustrated in the accompanying drawings.

Figure 1:
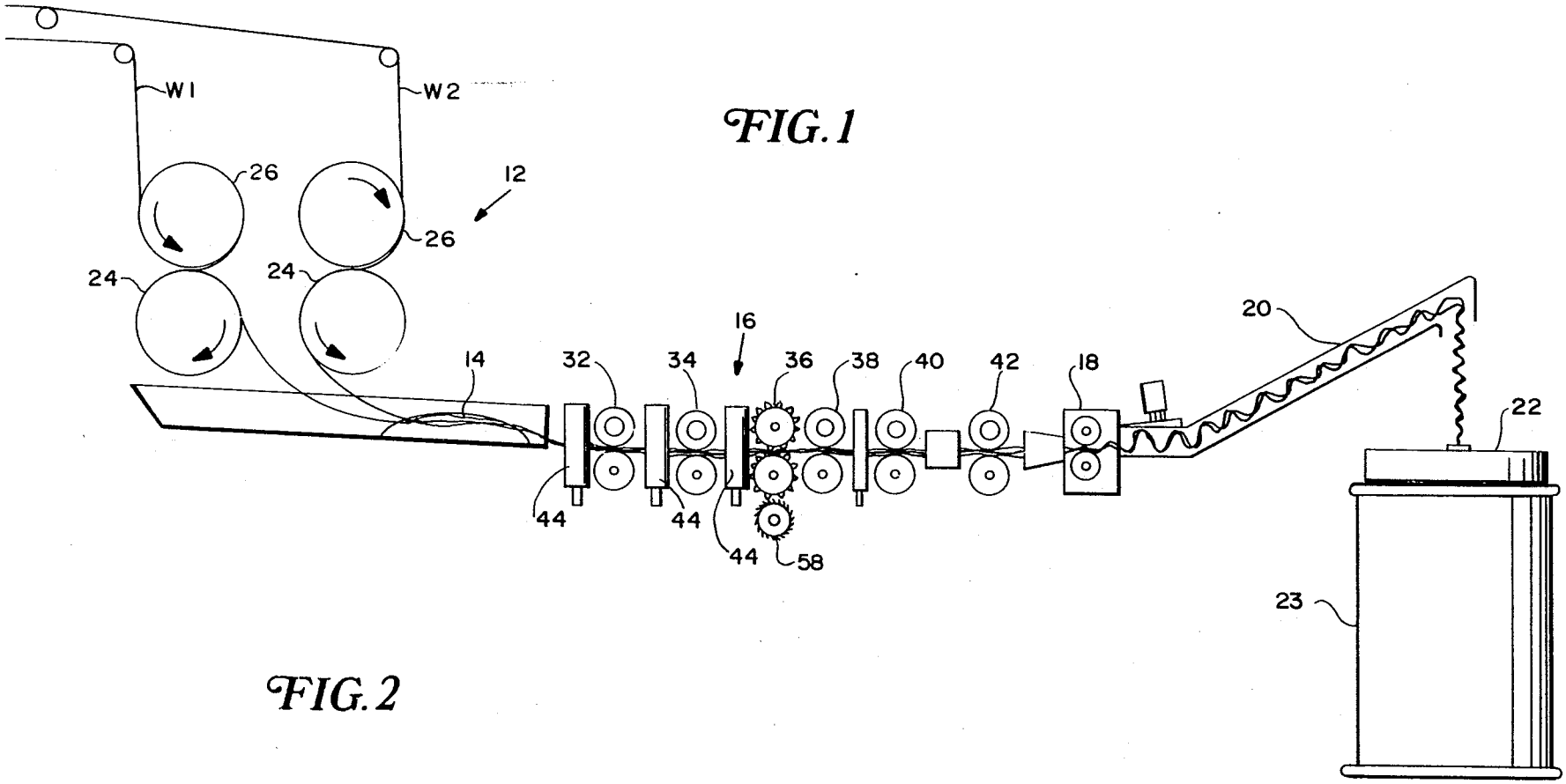
FIG. 1 is a schematic illustration of an exemplary embodiment of an apparatus and method for converting tow into sliver according to the present invention.
Figure 2:
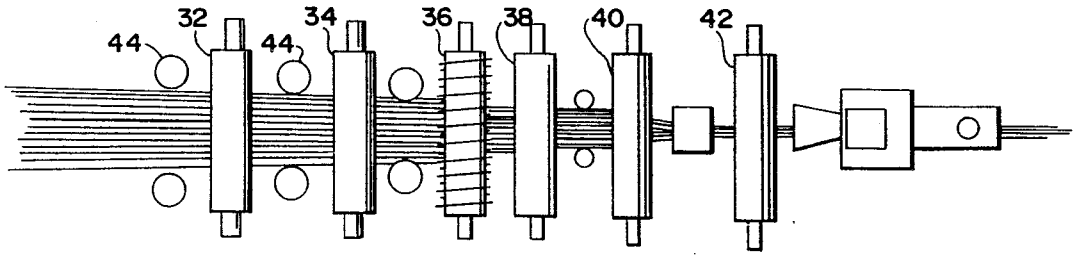
FIG. 2 is an enlarged plan view of the condensing and drafting section of the apparatus illustrated in FIG. 1.

Referring now to the drawings, particularly to the arrangement illustrated in FIGS. 1 and 2, there is illustrated a preferred form of apparatus for converting tow into sliver according to the present invention. More particularly, the apparatus includes a tow supply, not shown, for feeding tow to a cutter section, generally designated 12. The cut tow is passed through a collector pan 14 (discussed in detail hereinafter) for presentation to a drafting section, generally designated 16. The drafted tow web is condensed and passed through a crimper 18 and a crimper slide 20 for disposition in a sliver can 23 by a sliver coiler 22. Particulars of the foregoing arrangement will now be discussed in detail.

In the embodiment illustrated in FIG. 1, two tow ends are passed through the nips of longitudinally spaced pairs of cutting rolls, respectively. Each pair of cutting rolls includes an anvil roll 24 having a hard, smooth surface and a cutter roll 26 provided with helical lands. Thus, as the tow passes between the rotating cutting rolls, spaced portions of the tow fibers are compressed, with the spacing of fiber generally dependent on the pitch of the helical lands. Although the action referred to herein is called cutting, ideally the fibers are not completely severed by the cutting rolls, but rather, are weakened to the point that actually severing (herein sometimes called "debonding") readily takes place when the fiber is subjected to minimal tension, as in the following drafting zone. The lands of the cutter rolls 26 are preferably counter to one another so that when the webs W1 and W2 of tow are superposed one over the other on emergence from the cutters, the cutlines will extend as intersecting diagonals in plan relative to one another. Preferably, the cutting rolls provide for different cut lengths of the staple fiber. For example, for worsteds, two cut lengths are typically used, 3-½ inches and 4-½ inches, (which resemble the staple diagram of wool fibers). Thus, the tow webs W1 and W2, when cut, are presented in angularly related directions relative to one another and in superposed relation one to the other over collector pan 14, prior to presentation to drafting section 16, forming a diamond configuration with misalignment of the cut staple ends due to the different lengths of cut staple fiber.

Figure 3:
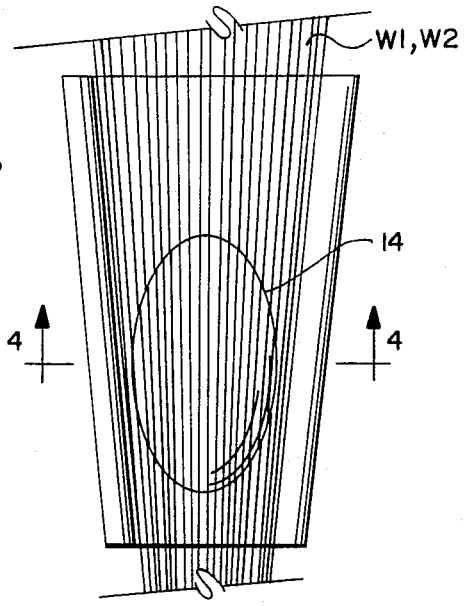
FIG. 3 is an enlarged plan view of a collector pan according to the present invention illustrating the passage of the web over the pan from the cutting rolls en route to the drafting section.
Figure 4:
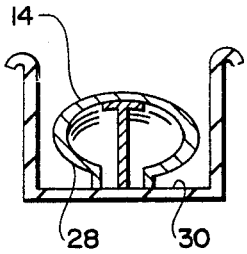
FIG. 4 is a cross-sectional view thereof taken generally about on line 4—4 in FIG. 3.

One of the principal problems associated with cut staple fiber prior to presentation to a drafting section has been failure to meet the above-mentioned ideal, that is, the cut tow web breaks or gaps open or both, permittng the fibers to be presented to the drafting section in a sideways configuration, resulting in defects such as neps, fiber clusters and turnbacks. The leading edges of the cut tow tend to separate and fold backwards, causing fiber entanglements and masses of unseparated fibers. To minimize or eliminate this problem,the combined webs W1 and W2 are passed over a particularly shaped collector pan 14. With reference to FIGS. 3 and 4, it will be seen that the collector pan 14 comprises an upwardly projecting convex surface or bulbous shape having rounded and inwardly directed undersides 28 spaced above the collector pan platform 30. Thus, as the combined webs W1 and W2 pass over the collector pan from the cutters, the combined web slides across the top of pan 14. Due to the convex or bulbous shape of pan 14, the lateral margins or selvages of the webs W1, W2 roll around the opposite sides and under pan 14 such that those margins are directed inwardly toward one another and lie in vertical registration below the main body of webs W1 and W2. Consequently, as the combined webs W1, W2 exit from the collector pan, the lateral margins or selvages of webs W1, W2 merge within the lateral confines of the main body of cut staple fibers for presentation to the drafting section 16.

It will be appreciated that the convex surface need not face upwardly and that the pan can be inverted. Other shapes and orientations will be apparent to those skilled in the art when it is recognized that to avoid breaks or gaps in the fibers or sideways orientation of the fibers with resulting defects, the tow web margins are located to register with the main body of the tow web prior to drafting.

Turning back now to FIGS. 1 and 2, the combined webs W1, W2 are presented to the drafting section 16 which includes superposed pairs of first and second drafting rolls 32 and 34, respectively, a pair of pin rolls 36 on opposite sides of the web and third, fourth and fifth pairs of drafting rolls 38, 40 and 42, respectively, likewise on opposite sides of the web passing through the drafting section 16. Vertically disposed compression rolls 44 are located on opposite sides of the web, with a pair of such rolls 44 disposed in front of the first pair of drafting rolls 32, between drafting rolls 32 and 34, between drafting rolls 34 and pin rolls 36 and between drafting rolls 38 and 40. The drafting rolls are, of course, rotated at increasing peripheral speeds in sequence from rolls 32, 34, 38, 40 and 42 in excess of the speed of the web as the web passes through the drafting section and in the direction of web travel in order that drafting may be accomplished.

While one set of pin rolls 36 is illustrated in this embodiment of the invention, it has been found desirable that the pin rolls be followed immediately by drafting rolls. Moreover, successive multiple sets of pin rolls cannot be successfully used in the absence of interposition of drafting rolls between the multiple sets of pin rolls. That is, where additional pairs of pin rolls are used, for example, as may be disposed between the drafting rolls 38 and 40, it is desirable that a pair of drafting rolls follow immediately each of the pairs of pin rolls 36. Furthermore, while it will be appreciated that pin rolls per se are not new in the textile industry, pin rolls with pins in interleaving engagement above and below a web for purposes of converting tow to staple has not, to applicant's knowledge, heretofore been used in the art.

The staple length and equivalent denier of the fiber being processed determines if more than one set of pin rollers is preferred. For example, using 4" staple, one set of 2-½" pin rolls (one-over-one) is satisfactory since the ratch setting between the intersection of the pin rolls and the nip of the drafting rolls is only about 4-½ inches. However, if a 7" or 8" staple was being processed, a double set of pin roll could be used with the advantage of separating the fibers more uniformly since the length of the fibers would be long enough to be held in both of the pin roll nips. Basically, little or no draft is imparted between the two sets of pin rolls. This is illustrated by FIGS. 11, 12, 13, 14, 15, 21, 22 and 23 herein.

Figure 5:
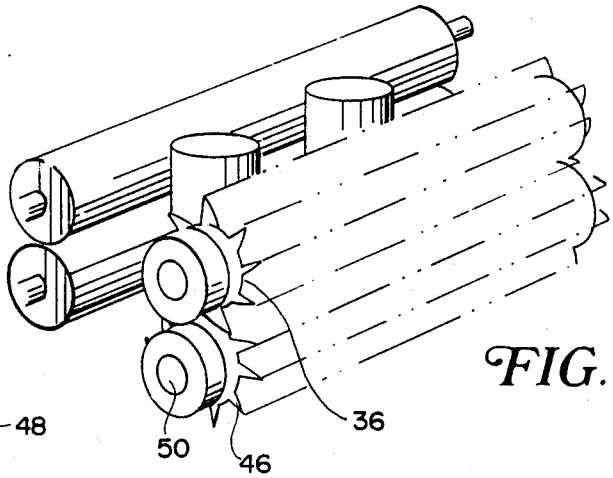
FIG. 5 is a perspective view illustrating a drafting and pin roll arrangement of the embodiment hereof illustrated in FIG. 1.
Figure 6:
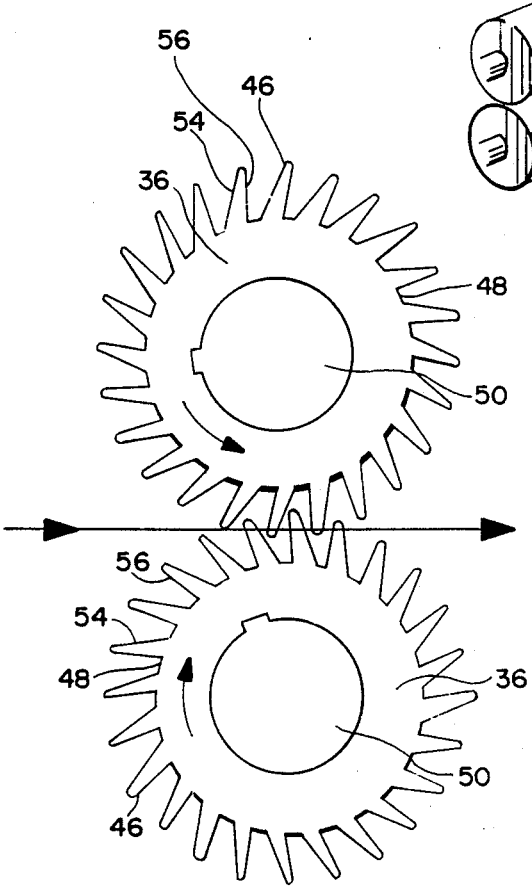
FIG. 6 is an enlarged schematic illustration of the interleaving engagement of the pin rolls with the tow web illustrated by the arrows.
Figure 7:
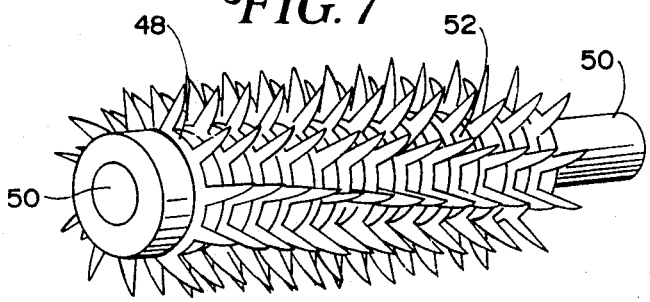
FIG. 7 is a perspective view of a representative example of a pin roll according to the present invention.

Turning now particularly to FIGS. 5, 6 and 7, the pin rolls each comprise a plurality of axially and circumferentially spaced projections or pins 46. In a preferred form of the present invention, each pin roll may comprise a plurality of disks 48, each having a plurality of circumferentially spaced pins 46 projecting from its outer surface. Each disk 48 is centrally apertured and keyed for disposition on a shaft 50. Each disk 48 is preferably spaced from an adjacent disk 48 by a spacer disk 52 (FIG. 7) having a smooth, circumferential surface adjacent the base of pins 46. It will be appreciated that different sizes of spacers can be provided, depending upon the nature of the web being combed and debonded by the pins.

It is a further feature of the pin rolls of the present invention that each of the projections has a leading and a trailing edge 54 and 56, respectively, which cooperate to facilitate, upon interleaving engagement of the pins with the adjacent pin roll and entry into the web between the pin rolls to preclude hooking the pin's on the fibers and carrying the fibers with the pins as the pins emerge from the fibers. To this end, it will be appreciated that the leading edge 54 of each pin extends at an acute angle relative to a radius passing through the projections and lags the radius in the direction opposite to the direction of rotation of the roll. That is, the leading edge 54 enters the fiber web prior to entry of the tip or point of the pin. Optimally, the pins of the pin rolls overlap by about 30–50% of their pin lengths. The optimal axial pin spacing is from 3/32–⅛ inch. Also, the disks mounting the pins of adjacent pin rolls preferably lie opposite one another so that the tow web may pass betWeen the aligned pins. Alternately, however, the pins of each roll could lie between the pins of the adjacent roll with slight axial spacing therebetween.

It is desirable to have the one-over-one pin roll combinations with the pins on one roll being dead center in the spaces between the pins on the other roll and penetrating to approximately 50% depth. The critical setting is not to allow the pin discs from one roll to make contact with the opposing pin roll because this would result in fiber damage and other defects. The synchronization of the pins top to bottom, for example, need not be in exact alignment but it is good practice to have them so aligned. In FIG. 7, the assembled pin rolls illustrate the pins positioned on the shaft on a diagonal. It wi11 be appreciated that the pins may likewise extend straight across the roll parallel to the axis with like performance.

As illustrated in FIG. 1, there is provided a roller brush 58 on the underside of the lower pin roll and in meshing engagement therewith. The brush is to prevent stock accumulation on the bottom pin roll. It has been found that stock does not accumulate on the top pin roll to ::he degree that it does on the bottom pin roll.

As indicated previously, the drafting section of the present apparatus permits higher production in comparison with the tow converters previously discussed. For example, it has been found that tow webs W1, W2 fed at 102 feet per minute at 2804 grains per yard delivered 600 grains per yard at 175 yards per minute with a draft of 8.3. This is a significant improvement in the weight of production in comparison with the prior converters in which production was limited by the speed of the faller bars, i.e., 1800 drops per minute.

It will be appreciated that the sliver exiting the drafting station 16 is now staple length oriented, combed and debonded and ready to be fed into the crimper 18 for purposes of making a compact sliver that can be run at high speeds. The sliver is then disposed in a sliver can 23 by the coiler 22.

While not specifically disclosed in conjunction with the embodiment hereof illustrated in FIGS. 1 and 2, it will be appreciated that a blending attachment may be provided, for example, to blend wool at the time the synthetic fabric is being cut and processed. Thus, wool can be fed behind and into the drafting rolls 38 on top of the synthetic staple, making a sandwich of synthetic fiber and the wool, i.e., polyester and wool. Thus, as the wool and synthetic fiber webs are subsequently drafted, they become a semi-intimate blend, passing through the remaining draft rolls and into the coiler at a desired delivery weight.

By the foregoing described invention, it will be appreciated that substantial increases in production are accomplished in a simple and unique manner. Additionally, a better quality fiber is produced. That is, defects, which are usually due to the tow pulling apart prematurely before being drafted, or the fibers not being straight or fiber ends turned sideways, are prevented in the present invention by the unique arrangement of the collector pan and speed synchronization between the cutter rolls and drafting roll 32 in FIG. 1 keeping the cut bonds from separating prior to presentation of the combined webs to the drafting section. The result is fewer neps and pinpoints and fewer long fibers. Improved quality is also a result of cutting only one tow in each cutter, as opposed to simultaneously cutting two tows as in prior machines with a single cutter. Moreover, the life of the cutters can be extended using the present machine because cutting pressure is greatly reduced. For example, in the previously discussed cutter, 6000 pounds of pressure was used, whereas only 4000 pounds is used in the present invention. Cutter pressure also depends upon the cutter blade sharpness which is normally 0.015" to 0.020" diameter land thickness. This reduction in pressure is permitted because only one tow is passing through each cutter. Additionally, it will be appreciated that the gill head has been totally eliminated, together with the problems associated with it. For example, the wear on the various moving parts of gill heads oftentimes is uneven and frequent replacement of those parts is required, causing machine downtime. Moreover, gill heads must be cleaned on a frequent basis, which requires further downtime. The stock oftentimes packs between the faller bar pins, requiring the pins to be cleaned and this proportionally increases defects in the stock. In the present invention, the pin rolls, which replace the faller bars, have spacing, both axially and circumferentially therebetween, as well as a brush which automatically cleans the lower roll. Additionally, gill heads and apron drafting apparatus were difficult to repair. For example, it normally took three to four hours to change an apron. In the present invention, repairs can be effected relatively quickly, for example, on the order of 15 minutes.

Figure 8:
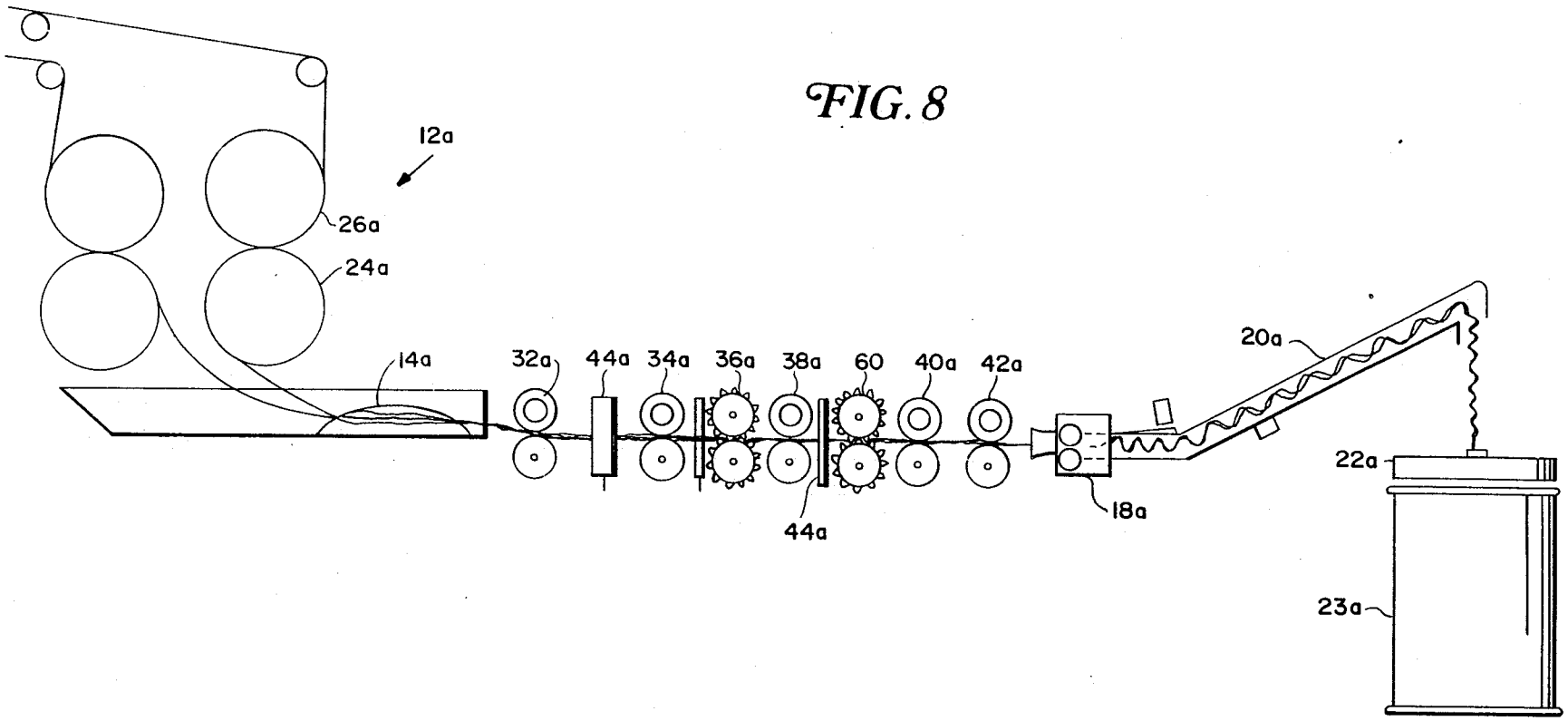
FIGS. 8, 9, 11–19 and 21–24 are schematic side elevational illustrations of different embodiments of apparatus for converting tow into sliver according to the present invention.

With respect to the succeeding embodiments which will now be described, like reference numerals are applied to like parts in each embodiment, followed by a letter suffix identifying the particular embodiment. Referring now to the additional embodiments of the present invention, there is illustrated in FIG. 8, a tow converter similar to the converter illustrated in FIG. 1, with the addition of another pin roll set immediately succeeding the drafting roll set 38*a*. Thus, in this embodiment, a second pair of pin rolls 60 are disposed behind the draft rolls 38*a* and the vertical rolls 44*a*. As indicated previously, the additional set of pin rolls cannot successfully be disposed directly behind the first set of pin rolls inasmuch as the first set of pin rolls desirably must be immediately succeeded by a set of draft rolls. The additional set of pin rolls provides for greater combing and debonding action.

Figure 9:
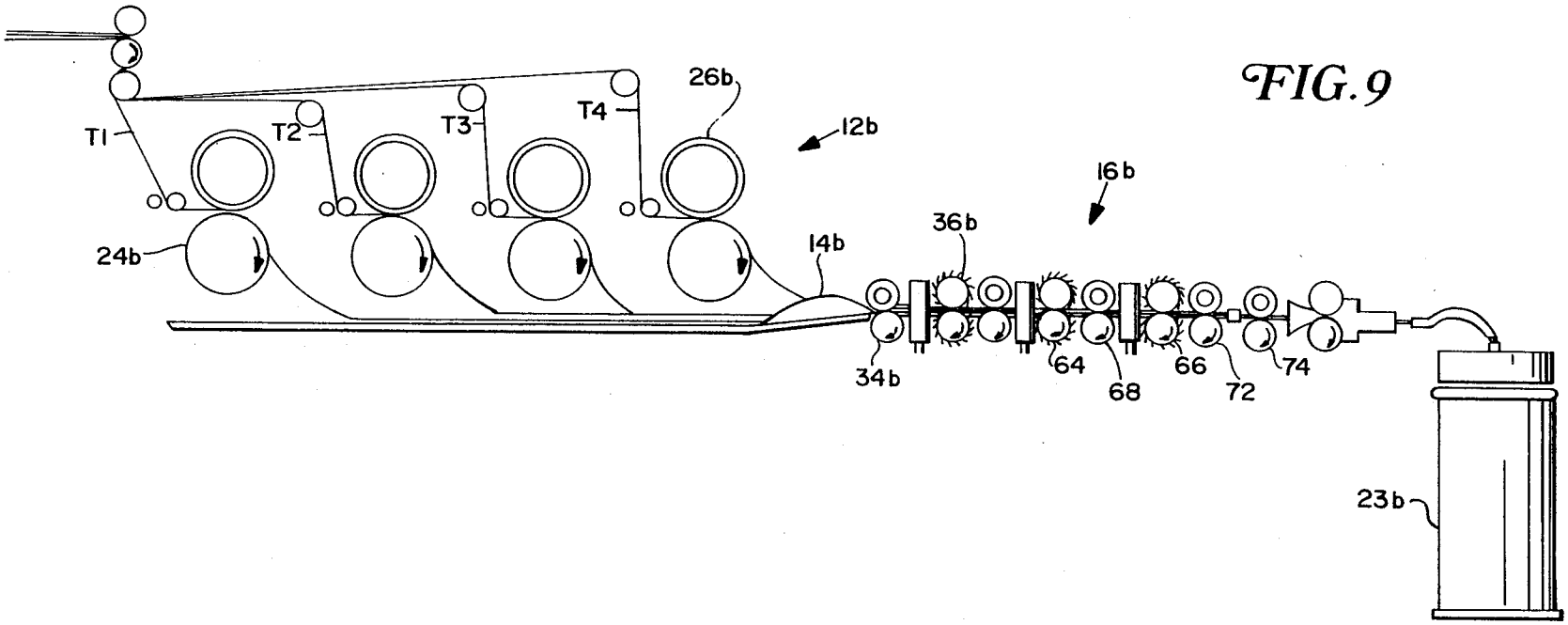
Figure 10:
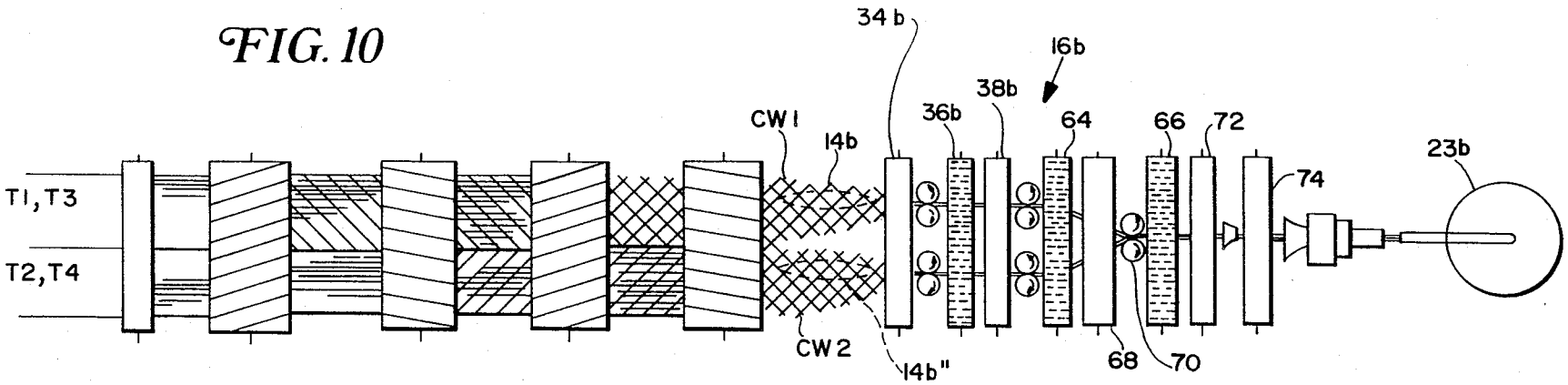
FIG. 10 is a schematic plan view of the apparatus illustrated in FIG. 9.

In the embodiment hereof illustrated in FIGS. 9 and 10, there is illustrated a converter using four cutter rolls in the cutting section 12*b*. In this form, two tows T1 and T3 are passed through cutter rolls having opposite helical lands and are superposed one over the other to form a first composite tow web CW1 passing over a collector pan 14*b*'. The other two tow webs T2 and T4 pass through similar cutter rolls having opposite helical lands to form a second composite web CW2 which likewise passes over a similar collector pan 14*b*". Thus, each web CW1 and CW2 has a diamond-shaped cut fiber orientation. The drafting section 16*b* is similar to that of FIG. 1, with the exception that two additional pin roll combinations 64 and 66 are provided downstream of the first pin roll 36*b*. Additionally, the drafting and pin rolls are axially extended to accommodate simultaneously each of the webs CW1 and CW2 as they pass through the drafting rolls 34*b*, the first pin rolls 36*b*, the draft rolls 38*b*, the pin rolls 64 and an immediately following set of draft rolls 68. Subsequent to the draft rolls 68, the two webs CW1 and CW2 are compressed laterally by compression rolls 70 and the composite web is then passed through a third and final set of pin rolls 66, followed by draft rolls 72 and 74.

Figure 11:
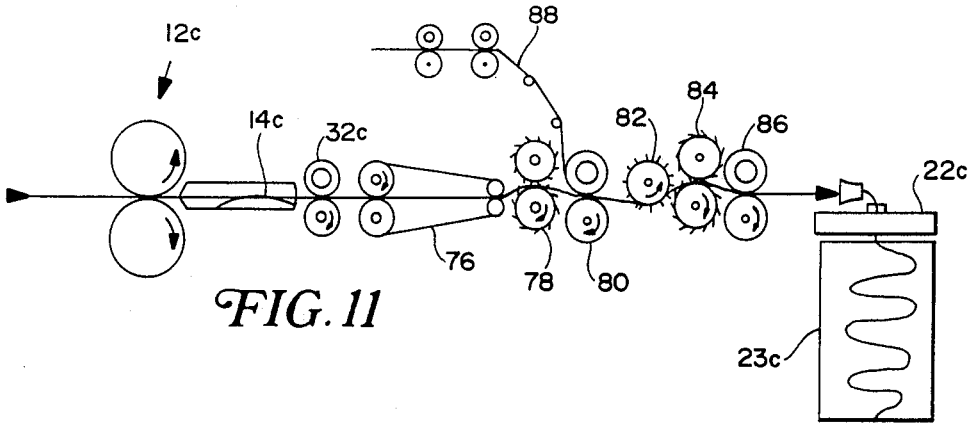

Referring now to FIG. 11, there is illustrated a tow converter having an apron drafting system in tandem with a double and triple pin roll combination, together with a blending attachment, for example, for combining polyester and wool. More particularly, the tow end is passed through a cutter section 12c and over collector pan 14c for disposition through a first draft roll set 32c. An apron drafting system, designated 76, is then employed and may, for example, comprise the system illustrated in U.S. Pat. No. 3,751,768. The web is then passed through a first pin roll set 78 and then through a set of draft rolls 80. The emerging web is then passed through a triple pin roller combination having a first pin roller 82 and a pair of pin rollers 84 defining a nip therebetween for receiving the web. The web then passes through subsequent draft rolls 86 and through the coiler 22c for disposition in the can 23c. The blending apparatus is schematically illustrated at 88 and disposes a web of dissimilar material, for example, wool, subsequent to the first pin roll set 78 for combination with the web passing therethrough prior to entry into the nip of the draft rolls 80. Thus, the wool is blended with, for example, the polyester staple fiber.

The three-pin roll combination illustrated (as also illustrated in FIGS. 12–15) allows the long staple fiber to penetrate into the pin rolls deeper than just the nip of a one-over-one pin roll combination. This is desirable when processing fibers that are not very parallel when entering the drafting system. Also, in FIGS. 11, 12, 13, 14 and 16, there are shown a double-apron combination which allows a closer nip setting to the pin rolls. This is mostly suitable for lightweight stock inputs, and also tends to develop the crimp in the stock by the slipping action of the fibers between the two apron surfaces.

Figure 12:
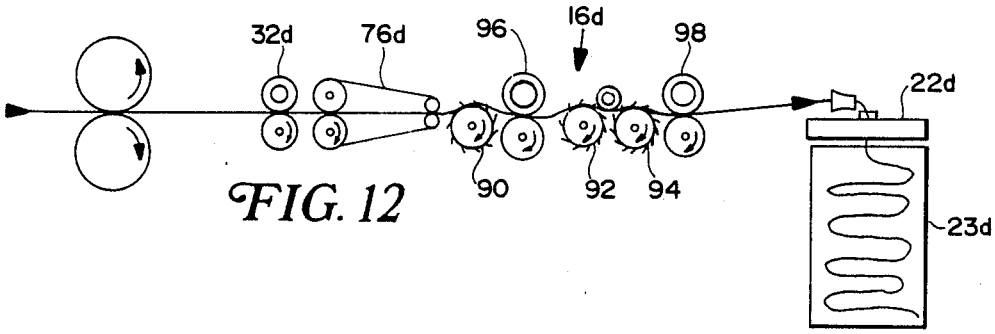

In the embodiment of FIG. 12, there is illustrated a three, single pin roll combination in the drafting section 16d. As in the previous embodiment, the web passes through drafting rolls 32d, an apron drafter 76d and passes sequentially over three pin rolls 90, 92 and 94. A set of draft rolls 96 are interposed between pin rolls 90 and 92 while a set of draft rolls 98 follow pin roll 94. The web then passes through a coiler 22d for disposition in can 23d.

Figure 13:
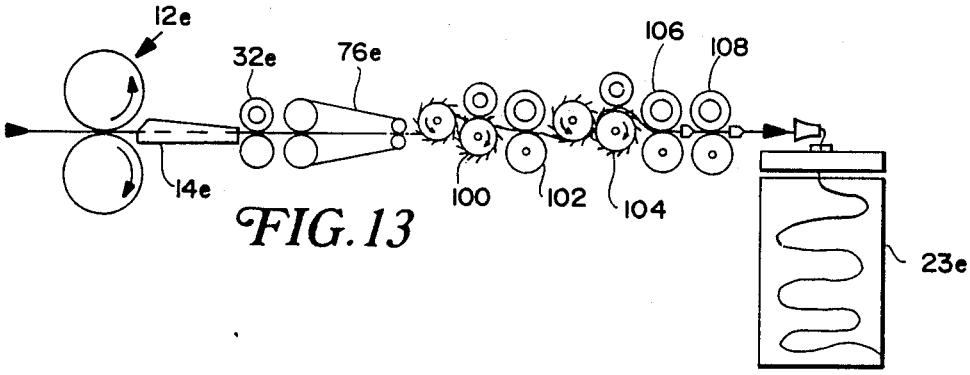

In FIG. 13, there is illustrated two, double pin roll combinations in the drafting section. Thus, the tow web passes through the cutter and anvil rolls of cutter section 12e, over pan 14e, through draw rolls 32e, an apron drafting system 76e, for transmission between pin rolls 100, a succeeding set of draft rolls 102, a second set of pin rolls 104 and two sets of draft rolls 106 and 108, respectively, before the web is disposed in the can 23e.

Figure 14:
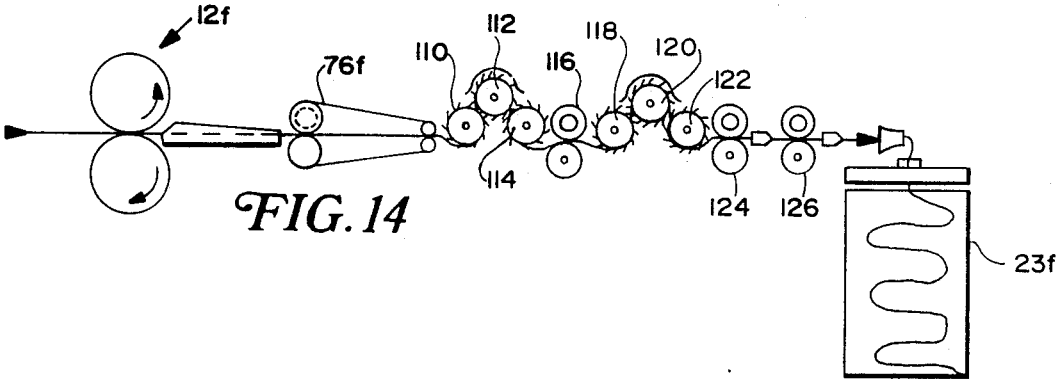

In FIG. 14, two triple pin roll combinations are employed. Thus, the web passes from cutter section 12f, through apron drafting section 76f about a first pin roll 110 for transfer to and disposition about a second pin roll 112. The web is then transferred to a third pin roll 114, passes through a set of draft rolls 116 and then passes through another set of three pin rolls, arranged similarly as previously described, i.e., first about pin roll 118, then about pin roll 120 and thereafter about pin roll 122. Upon emergence from pin roll 122, the web passes through two sets of draft rolls 124 and 126, whereupon the web is disposed in can 23f.

Figure 15:
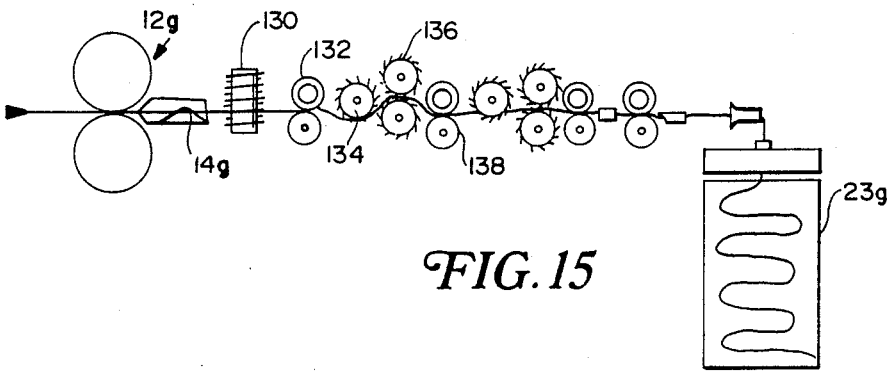

The embodiment in FIG. 15 discloses a triple pin roll arrangement, with a pair of vertical pin rolls to compress or control the cutlines of the tow. Thus, the web emerging from the cutter section 12g and over the collector pan 14g first passes between a pair of vertically disposed pin rolls 130. This particularly controls the cut ends of the tow. The tow web is then passed through draft rolls 132, under a first horizontal pin roll 134 and through the nip of a pair of pin rolls 136, followed by a pair of draft rolls 138. The cut tow web then passes through a similar triple pin roll arrangement, followed by two sets of draft rolls for final disposition in can 23g.

Figure 16:
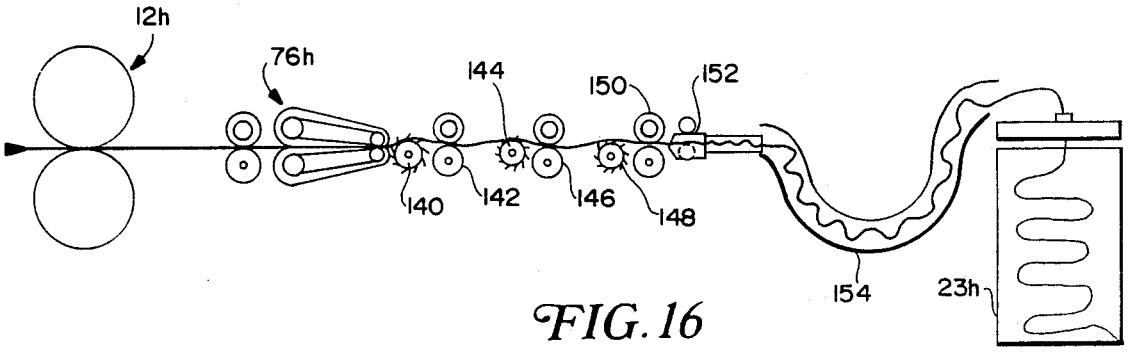

Turning now to FIG. 16, there is disclosed a three, single pin roll arrangement in conjunction with a crimper. Here, the web passes from the cutter section 12h through an apron drafting system 76h, over a first pin roll 140, through a pair of drafting rolls 142, over a second pin roll 144, through a pair of drafting rolls 146, over a third pin roll 148, through a pair of drafting rolls 150 into a crimper 152 for passage through an autocoiler 154 into can 23h. The embodiment shown in FIG. 16 is shown as using only one pin roll instead of a one-over-one or a three-roll combination. This is successful when lightweight stock is being processed and the stock bulk is not too great to cause fibers to lift out of the pins and go uncombed. This single pin roll is used only for light, low bulk fibers.

Figure 17:
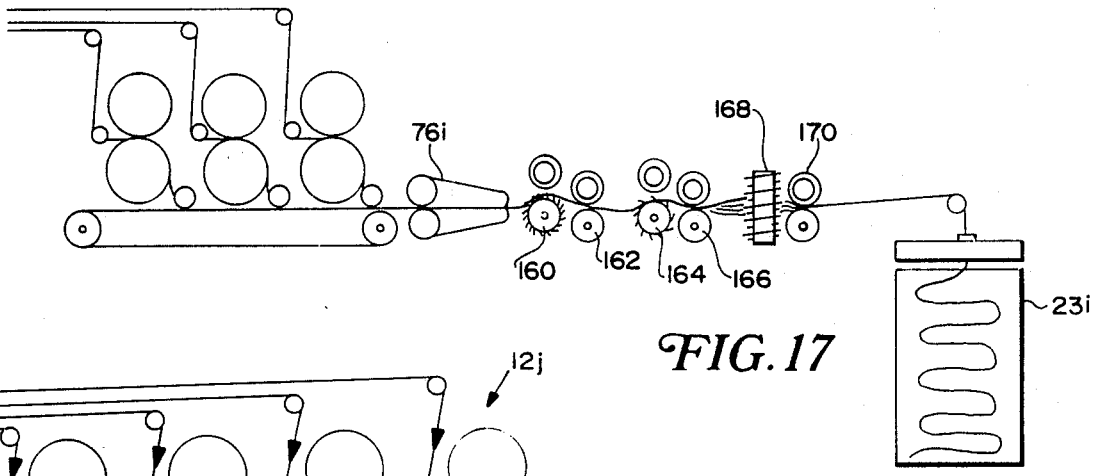

Referring now to FIG. 17, there is illustrated three pairs of cutting rolls in cutter section 12i for cutting three tow webs and superposing the tow webs over one another for passage through an apron drafting system 76i. The web passes over a first pin roll 160 and then through a pair of draft rolls 162. The web then passes over a second pin roll 164 and through a second pair of drafting rolls 166. A single vertical pin roll 168 is disposed to one side of the web for further combing and debonding of the web, with the web passing through a third set of draft rolls 170 for disposition in can 23i. Follower roll 160a is a self-weighted felt roll that keeps the fibers down into the pin roller, preventing fibers from skipping off the roller top such that they would not be processed.

Figure 18:
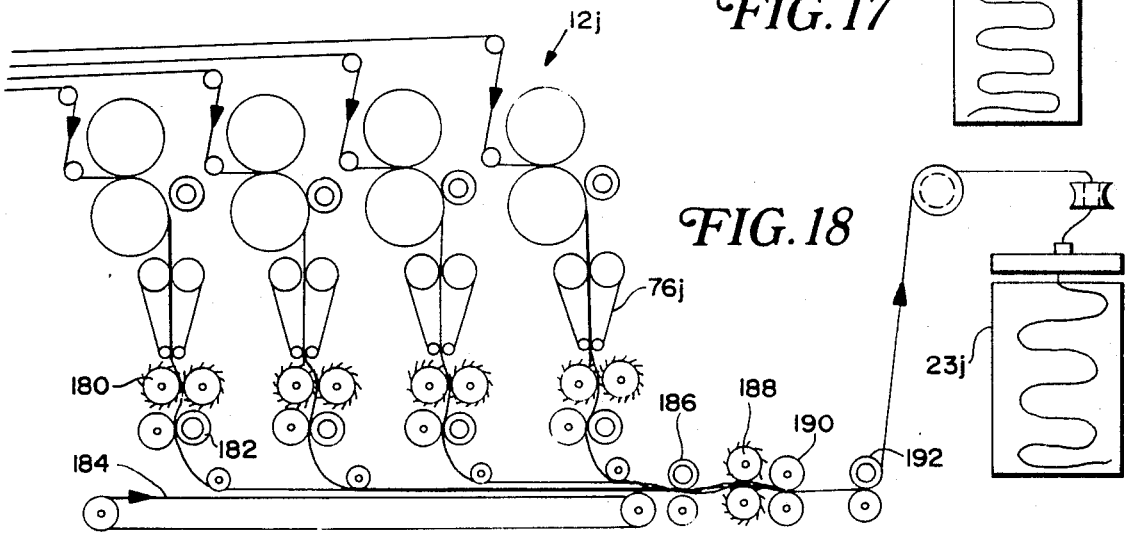

In FIG. 18, there is disclosed a cutter section 12j having four cutter rolls for supplying discrete webs to four apron drafting systems 76j. In this form, the apron drafting systems are vertically disposed. The webs are then passed through pairs of pin rolls 180 with intermeshing teeth followed by pairs of draft rolls 182. The webs are then laid on a conveyor 184 for superposition over one another and pass through a pair of draft rolls 186, a set of pin rolls 188 and two sets of drafting rolls 190 and 192, respectively. The composite web is then passed to a coiler for disposition in the can 23j.

Figure 19:
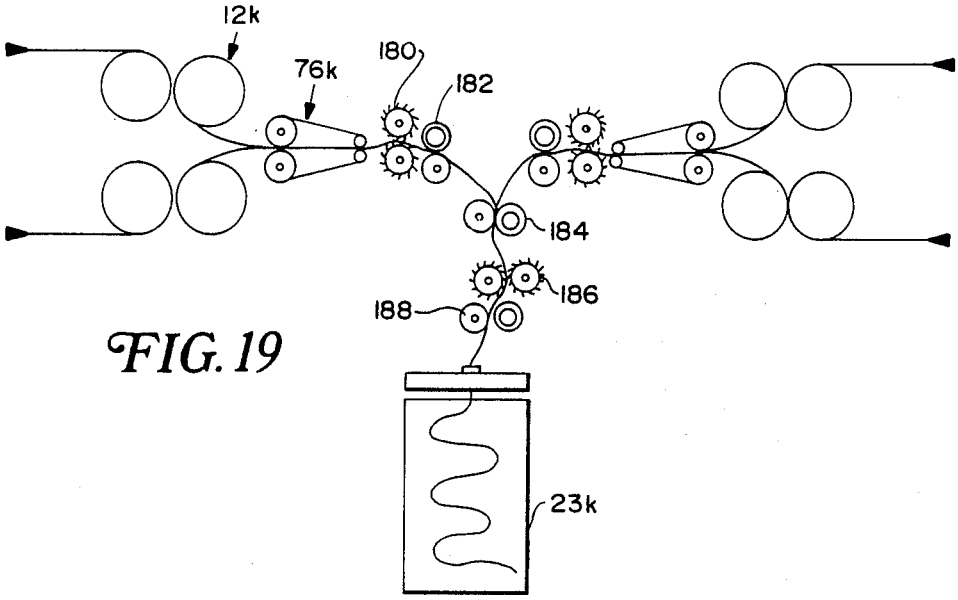

In FIG. 19, there is illustrated a cutter section 12k, an apron section 76k and first sets of pin rolls and draft rolls 180 and 182, respectively, similarly as in the preceding embodiment except arranged horizontally rather than vertically. Another similar set of cutters, apron drafting system, pin rolls and drafting rolls are disposed in opposition or as a mirror image to the first described set so that the pair of webs combined on each side are subsequently combined one with the other through a first pair of central drafting rolls 184. The composite web then passes through a set of pin rolls 186 and a pair of drafting rolls 188 for final disposition in the can 23k.

Figure 20:
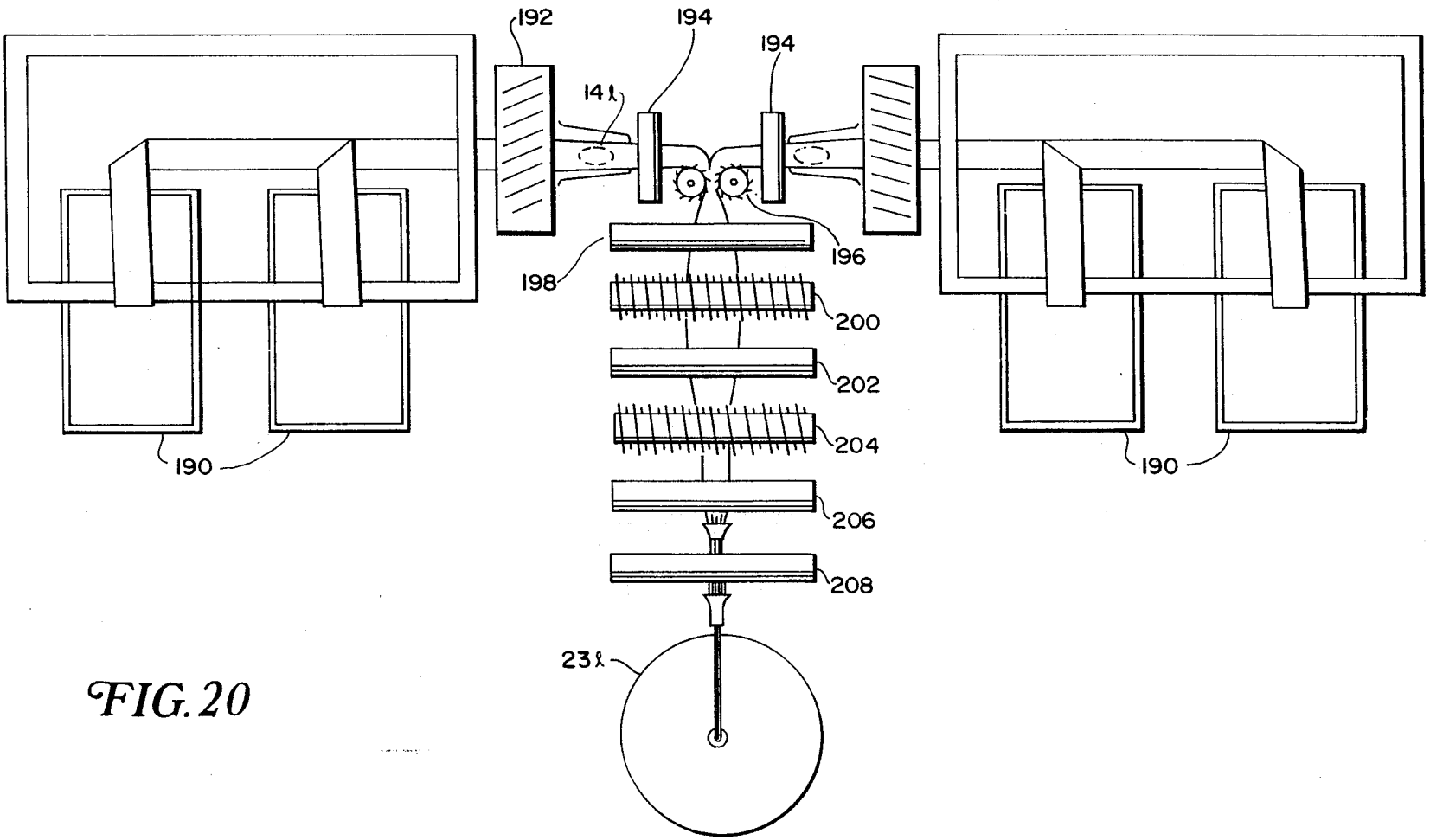
FIG. 20 is a schematic illustration in plan of another apparatus for converting tow into sliver according to the present invention.

Referring now to FIG. 20, there is illustrated in plan view adjacent each of the opposite sides of the machine depicted in this drawing Figure, two tow cartons 190 for supplying tow to two sets of cutter rolls 192 disposed vertically one over the other (only the top set can be seen in FIG. 20) and through which the two tow ends are combined to form a composite web for passage over a collector pan 141. Thus, the two composite webs (i.e., one from the left side and one from the right) move toward one another past a first pair of drafting rolls 194 and then change direction by passage through a pair of vertically disposed pin rolls 196. The four webs, now in composite form, pass through a pair of drafting rolls 198, a pair of pin rolls 200, a pair of drafting rolls 202, a pair of pin rolls 204 and subsequently through two sets of drafting rolls 206 and 208 for disposition in can 231.

Figure 21:
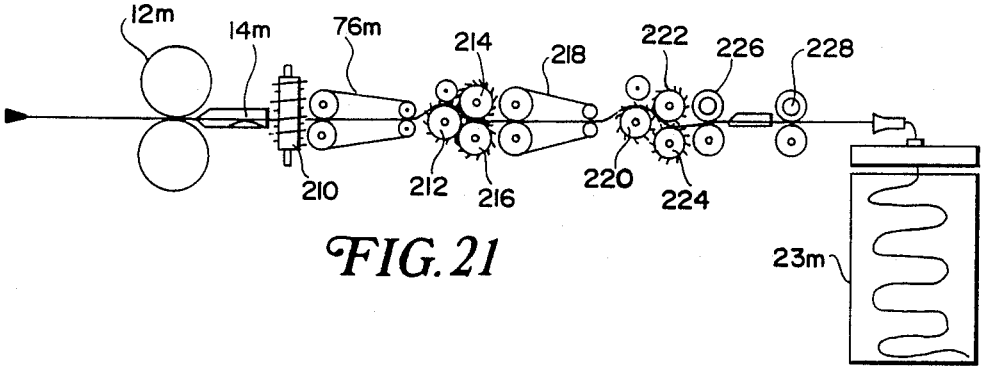

Referring now to FIG. 21, there is illustrated an arrangement wherein the web from cutter 12 m and collector pan **14*m* passes a pair of vertically disposed pin rolls 210 for entry into an apron drafting system 76*m*. The web passes from the apron drafting mechanism 76*m* through a triple pin roll arrangement comprised of a first pin roll 212 and second and third opposed pin rolls 214 and 216, respectively. The web then passes through a second apron drafting mechanism 218 for presentation to a second triple pin roll arrangement, including a first pin roll 220 and' upper and lower pin rolls 222 and 224. The web then passes through sets of drafting rolls 226 and 228** for final disposition in the can 23m.

Figure 22:
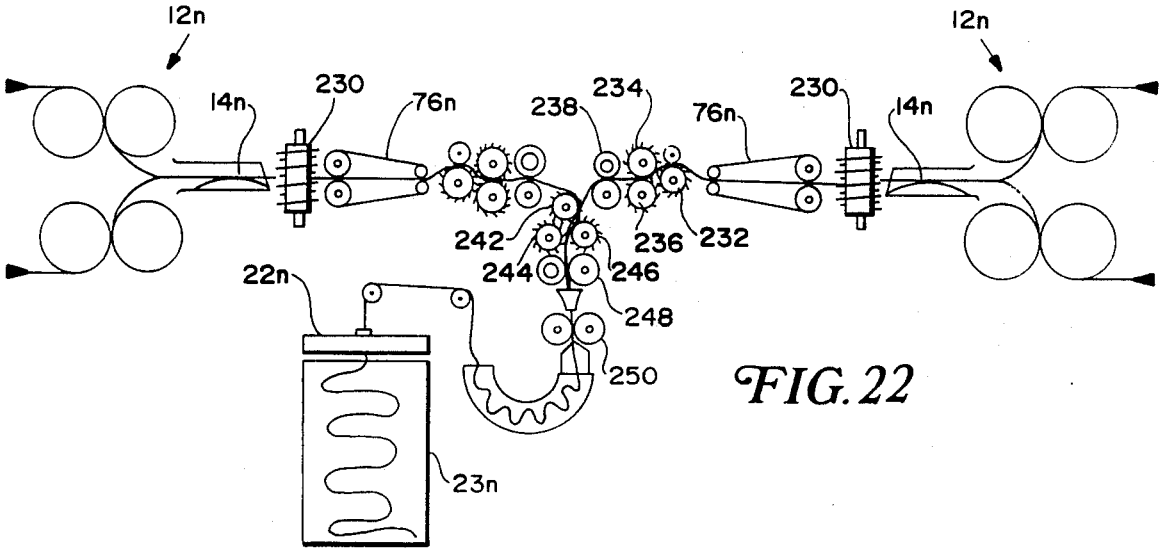

The embodiment illustrated in FIG. 22 employs four cutters **12*n* with two each on opposite sides of the converter. Thus, each pair of cutters feeds a pair of composite tow webs over a collector pan 14*n* through a pair of vertically disposed pin rolls 230, a drafting system 76*n* and finally through a triple pin roll arrangement comprising a first pin roll 232 with upper and lower pin rolls 234 and 236, respectively, followed by a set of drafting rolls 238. The two composite webs are then brought together for passage vertically through a triple pin roll arrangement comprised of a first pin roll 242 and a pair of pin rolls 244 and 246, followed by two sets of drafting rolls 248 and 250. The sliver is then disposed in the can 23*n* by the coiler 22*n***.

Figure 23:
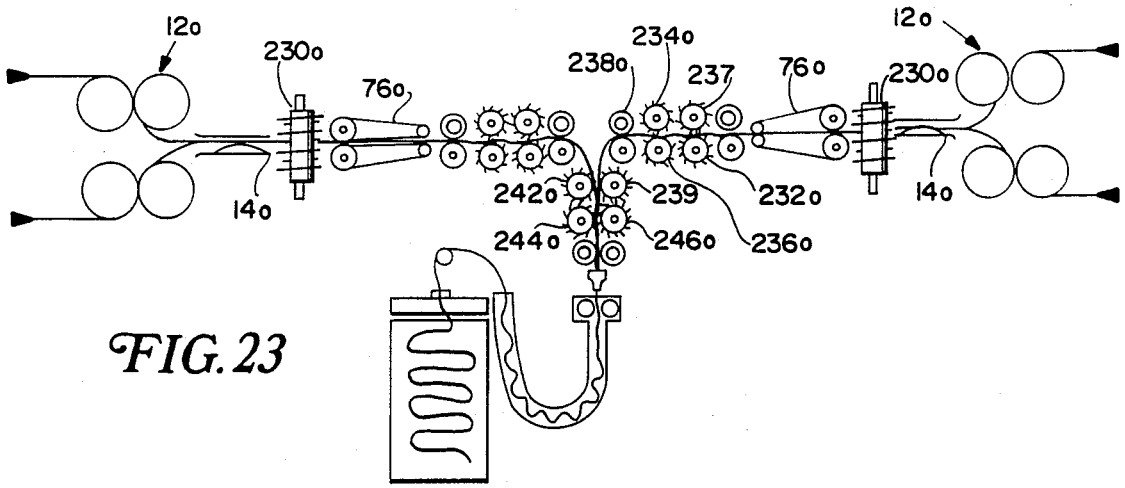

Referring now to drawing FIG. 23, there is illustrated a converter similar to the embodiment illustrated in FIG. 22 except that the drafting section for each pair of the composite webs and the final drafting section each uses two pairs of pin rolls rather than the three pin rolls indicated in FIG. 23. Thus, instead of pin roll **232*o* being followed by a smooth roll in each composite web drafting section, it is followed by another pin roll pair 234*o* and 236*o*. In the final drafting section, the pin roll pair 242 and 239 is followed by an additional pin roll pair 244*o* and 246*o***. This arrangement is particularly useful for high bulk, very long staple length fibers.

Figure 24:
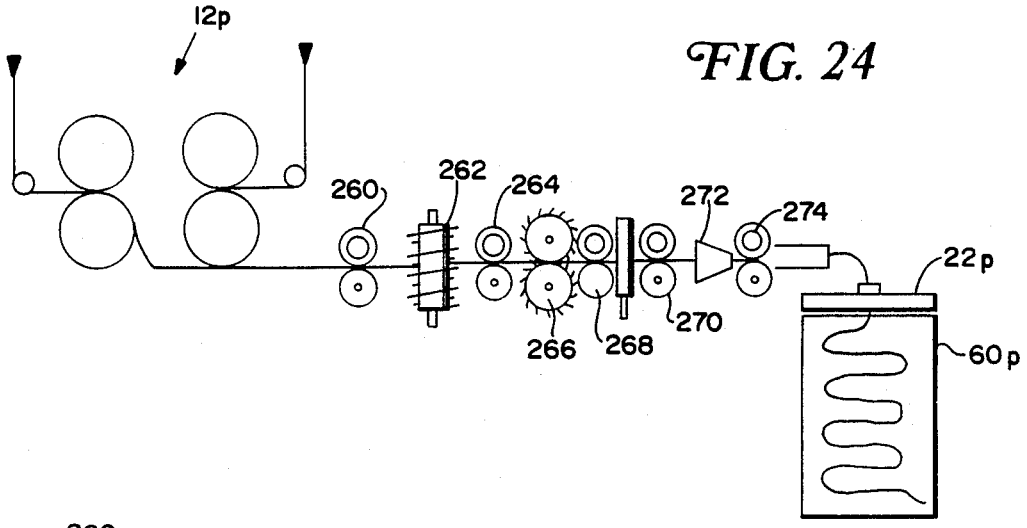

Referring now to FIG. 24, there is illustrated a cutter section **12*p* for cutting two tow ends which are laid one on top of the other for passage through a first set of drafting rolls 260, a pair of vertically disposed pin rolls 262, and a pair of drafting rolls 264. The web is then disposed between a pair of pin rolls 266, followed by drafting rolls 268 and 270, likewise followed by a condensor 272 and a final set of draft rolls 274. From rolls 274, the sliver is disposed in the can 23*p* by the coiler 22*p***.

Figure 25:
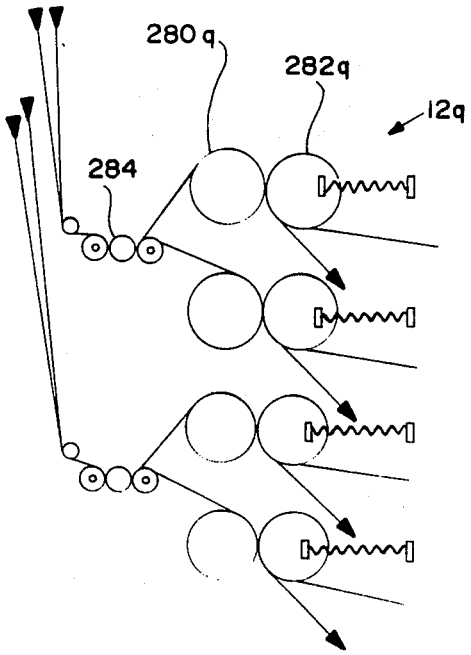
FIG. 25 is a side elevational schematic illustration of a tow creel and cutter arrangement.

Finally, referring to FIG. 25, there is illustrated a cutter **12*q* comprised of stacked cutter rolls. That is, each anvil roll 280*q* is stacked above the anvil roll 280*q* of the lower cutters and in opposition to a cutter roll 282*q*. Each cutter roll 282*q* is likewise stacked above one another and is held under spring tension against the associated anvil. Thus, four tow ends are passed through feed rollers 284 for passage through each of a pair of the superposed cutters 12*q***.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for converting tow of continuous filament fibers to sliver, comprising:

means for feeding a web of tow from a supply through the converting apparatus;

means for cutting the web to provide fiber weakened zones at longitudinally spaced positions therealong and substantially without complete severing the fiber;

means for turning the cut fibers along at least one marginal portion of the cut tow web into registration with a main portion of the tow web inwardly upon itself of said marginal portion; and a drafting section for receiving the tow web including the registering turned marginal and main portions for forming the sliver.

2. Apparatus according to claim 1 including means for turning the cut fibers along the marginal portion of said cut tow web opposite the one marginal portion into registration with the main portion of the tow web.

3. Apparatus according to claim 2 wherein said turning means includes surfaces extending in a direction generally transverse to the direction of web movement.

4. Apparatus according to claim 3 including a collector pan having a main surface over which the main portion of the tow web passes, said turning surfaces comprising continuations of said main surface such that portions of the turning surfaces in contact with the marginal portions of the cut tow web lie in registration with portions of the main surface in contact with the main portion of the web.

5. Apparatus according to claim 4 wherein said main surface is also curved in the direction of web travel.

6. Apparatus according to claim 5 wherein said main surface is generally convex in an upward direction and the cut tow web overlies said convex curved surface.

7. Apparatus according to claim 1 wherein said drafting section includes a pin roll and a pair of drafting rolls, means for rotating said pin roll and said draft rolls, said draft rolls immediately following said pin roll in the downstream direction of movement of the tow web.

8. Apparatus according to claim 7 wherein said pin roll has a plurality of projections spaced circumferentially one from the other thereabout and axially spaced along said pin roll, said projections extending from the surface of said pin roll and having leading edges extending at an acute angle relative to a radius passing through said projections and lagging said radius in a direction opposite to the direction of rotation of said roller.

9. Apparatus according to claim 8, including a second pin roll having a plurality of projections extending therefrom, the projections of said second pin roll being spaced circumferentially one from the other about said second pin roll and spaced axially one from the other therealong, each said projection of said second pin roll having a tip and leading and trailing edges extending therealong toward said tip, each said leading edge extending in a direction to engage the web first along the leading edge followed by engagement of said tip with the web as the second pin roll is rotated and engages the web, the projections of said first and second pin rolls are interleaved with one another on opposite sides of the web.

10. A method of processing tow of continuous filament fiber to sliver in a converter, comprising:

feeding a web of tow from a supply through the converter;

cutting the tow web to provide weakened zones in said fibers at longitudinally spaced positions therealong and substantially without complete severing of the fibers;

turning the cut fibers along at least one marginal portion of the cut tow web into registration with a main portion of the tow web inwardly of said marginal portion; and passing the tow web including the registering turned marginal and main portions through a drafting section to form the sliver.

11. A method according to claim 10 including turning the cut fibers along the marginal portion of the cut tow web opposite the one marginal portion into registration with the main portion of the tow web.

12. A method according to claim 11 wherein the step of turning includes providing a pair of surfaces curved in a direction generally transverse to the direction of web movement and passing the opposite marginal portions of the tow web about the curved surfaces.

13. A method according to claim 12 including the steps of providing a main surface over which the main portion of the tow web passes, and forming the curved surface as a continuation of the main surface in the directions generally transverse to the direction of web movement such that portions of the curved surfaces in contact with the lateral marginal portions of the cut tow web register with portions of the main surface in contact with the main portion of the web.

14. A method according to claim 13 including curving said main surface in the direction of web travel.

15. A method according to claim 14 including forming the main surface generally convex in an upward direction and passing the cut tow web over said convex curved main surface and about said marginal curved surfaces.

16. A method according to claim 10 including passing the cut tow web through a drafting section which includes a pin roll and a pair of drafting rolls downstream of the pin roll in the direction of movement of the tow, and rotating the pin roll and draft rolls at a peripheral speed greater than the linear speed of the cut tow web passing through the drafting section.

17. A method according to claim 16 wherein the pin roll has been provided with a plurality of projections spaced circumferentially one from the other and spaced axially along the pin roll, with the leading edges of the projections at an acute angle relative to a radius passing through the projections and lagging the radius in a direction opposite to the direction of rotation of the roller.

* * * * *